US008632360B2

(12) United States Patent
Tremba et al.

(10) Patent No.: US 8,632,360 B2
(45) Date of Patent: Jan. 21, 2014

(54) COAXIAL CABLE CONNECTOR HAVING A COLLAPSIBLE PORTION

(75) Inventors: Timothy Noel Tremba, Cayuta, NY (US); Brian Derenthal, Horseheads, NY (US); Harold Watkins, Horseheads, NY (US); Bruce Hauver, Elmira, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 13/093,736

(22) Filed: Apr. 25, 2011

(65) Prior Publication Data

US 2012/0270439 A1 Oct. 25, 2012

(51) Int. Cl.
*H01R 9/05* (2006.01)

(52) U.S. Cl.
USPC ..... 439/578

(58) Field of Classification Search
USPC ..... 439/578, 584–585, 321
See application file for complete search history.

(56) References Cited

U.S. PATENT DOCUMENTS

| | | | | |
|---|---|---|---|---|
| 2,691,059 | A | 10/1954 | Umina | |
| 3,171,707 | A | 3/1965 | Powell | |
| 3,184,706 | A | 5/1965 | Atkins | |
| 3,375,485 | A | 3/1968 | Donohue et al. | |
| 3,579,282 | A * | 5/1971 | Couper | 333/260 |
| 3,581,269 | A | 5/1971 | Frey et al. | |
| 3,744,007 | A | 7/1973 | Horak | |
| 3,744,011 | A | 7/1973 | Blanchenot | |
| 4,093,335 | A | 6/1978 | Schwartz et al. | |
| 4,456,323 | A | 6/1984 | Pitcher et al. | |
| 4,614,390 | A | 9/1986 | Baker | |
| 4,717,355 | A | 1/1988 | Mattis | |
| 4,834,676 | A | 5/1989 | Tackett | |
| 5,295,864 | A | 3/1994 | Birch et al. | |
| 5,466,173 | A | 11/1995 | Down | |
| 5,470,257 | A | 11/1995 | Szegda | |
| 5,501,616 | A | 3/1996 | Holliday | |
| 5,525,076 | A | 6/1996 | Down | |
| 5,632,651 | A | 5/1997 | Szegda | |
| 5,888,094 | A | 3/1999 | Kubota et al. | |
| 5,975,951 | A | 11/1999 | Burris et al. | |
| 5,993,254 | A | 11/1999 | Pitschi et al. | |
| 5,997,350 | A | 12/1999 | Burris et al. | |
| 6,042,422 | A | 3/2000 | Youtsey | |
| 6,089,912 | A | 7/2000 | Tallis et al. | |
| 6,322,390 | B1 | 11/2001 | Takeuchi | |
| 6,478,618 | B2 | 11/2002 | Wong | |

(Continued)

OTHER PUBLICATIONS

Office Action for U.S. Appl. No. 12/387,830, mail date Apr. 11, 2011, 10 pages.

(Continued)

*Primary Examiner* — Jean F Duverne
(74) *Attorney, Agent, or Firm* — Hiscock & Barclay LLP

(57) ABSTRACT

A coaxial cable connector is configured to connect a coaxial cable to a mating connector. The coaxial cable connector includes a connector body having a forward end and a rearward end opposite the forward end, the rearward end configured to receive a coaxial cable; an annular post disposed at least partially within the connector body; and a sleeve configured to be received within the connector body and movable from a first position to a second position relative to the connector body. The sleeve includes a collapsible portion configured to collapse radially inward in an asymmetric fashion toward the post as the collapsible sleeve is moved from the first position to the second position.

19 Claims, 16 Drawing Sheets

(56) References Cited

U.S. PATENT DOCUMENTS

| | | | | |
|---|---|---|---|---|
| 6,530,807 | B2 | 3/2003 | Rodrigues et al. | |
| 6,634,906 | B1 | 10/2003 | Yeh | |
| 6,716,061 | B2 * | 4/2004 | Pitschi et al. | 439/578 |
| 6,767,248 | B1 | 7/2004 | Hung | |
| 6,767,249 | B1 | 7/2004 | Li | |
| 6,773,303 | B1 * | 8/2004 | Lin | 439/578 |
| 6,776,657 | B1 | 8/2004 | Hung | |
| 6,780,052 | B2 | 8/2004 | Montena et al. | |
| 6,790,083 | B1 * | 9/2004 | Chen | 439/583 |
| 6,793,529 | B1 | 9/2004 | Buenz | |
| 6,808,415 | B1 | 10/2004 | Montena | |
| 6,817,897 | B2 | 11/2004 | Chee | |
| 6,830,479 | B2 * | 12/2004 | Holliday | 439/585 |
| 6,848,939 | B2 * | 2/2005 | Stirling | 439/578 |
| 6,887,103 | B2 | 5/2005 | Montena et al. | |
| 6,893,290 | B2 | 5/2005 | Buenz et al. | |
| 6,994,588 | B2 | 2/2006 | Montena | |
| 7,008,264 | B2 | 3/2006 | Wild | |
| 7,018,235 | B1 | 3/2006 | Burris | |
| 7,021,965 | B1 | 4/2006 | Montena et al. | |
| 7,029,326 | B2 | 4/2006 | Montena | |
| 7,048,579 | B2 | 5/2006 | Montena | |
| 7,118,416 | B2 | 10/2006 | Montena et al. | |
| 7,128,603 | B2 | 10/2006 | Burris et al. | |
| 7,131,868 | B2 | 11/2006 | Montena | |
| 7,182,639 | B2 | 2/2007 | Burris | |
| 7,252,546 | B1 | 8/2007 | Holland | |
| 7,255,598 | B2 | 8/2007 | Montena et al. | |
| 7,297,023 | B2 | 11/2007 | Chawgo | |
| 7,329,149 | B2 | 2/2008 | Montena | |
| 7,354,307 | B2 | 4/2008 | Chee et al. | |
| 7,364,462 | B2 * | 4/2008 | Holland | 439/584 |
| 7,371,112 | B2 | 5/2008 | Burris et al. | |
| 7,422,479 | B2 | 9/2008 | Chee et al. | |
| 7,452,237 | B1 | 11/2008 | Montena | |
| 7,455,549 | B2 | 11/2008 | Rodrigues et al. | |
| 7,473,128 | B2 | 1/2009 | Montena | |
| 7,507,116 | B2 | 3/2009 | Laerke et al. | |
| 7,566,236 | B2 | 7/2009 | Malloy et al. | |
| 7,568,945 | B2 | 8/2009 | Chee et al. | |
| RE41,044 | E | 12/2009 | Hung | |
| 7,741,562 | B2 | 6/2010 | Crotinger et al. | |
| 8,096,830 | B2 * | 1/2012 | Rodrigues | 439/584 |
| 2005/0003706 | A1 * | 1/2005 | Montena | 439/578 |
| 2007/0020973 | A1 | 1/2007 | Sattele et al. | |
| 2007/0049113 | A1 | 3/2007 | Rodrigues et al. | |

OTHER PUBLICATIONS

Notice of Allowance for U.S. Appl. No. 12/387,830, mail date Sep. 21, 2011, 9 pages.

International Search Report and Written Opinion for PCT Application No. PCT/US2012/034279, mailed Nov. 30, 2012, 10 pages.

* cited by examiner

COAXIAL CABLE CONNECTOR HAVING A COLLAPSIBLE PORTION

BACKGROUND

The present disclosure relates generally to the field of coaxial cable connectors used to connect coaxial cables to various electronic devices such as televisions, antennas, set-top boxes, and similar devices. More specifically, the present disclosure relates to a coaxial cable connector having a collapsible portion.

Conventional coaxial cable connectors generally include a connector body, a nut coupled to the connector body, and an annular post coupled to the nut and/or the body. A locking sleeve may further be used to secure a coaxial cable within the body of the coaxial cable connector.

There are many challenges associated with providing coaxial cable connectors that are low cost and maintain high quality connections with coaxial cables.

SUMMARY

One embodiment relates to a coaxial cable connector configured to connect a coaxial cable to a mating connector, the coaxial cable connector comprising a connector body having a forward end and a rearward end opposite the forward end, the rearward end configured to receive a coaxial cable; an annular post disposed at least partially within the connector body; and a sleeve configured to be received within the connector body and movable from a first position to a second position relative to the connector body; wherein the sleeve comprises a collapsible portion configured to collapse radially inward in an asymmetric fashion toward the post as the collapsible sleeve is moved from the first position to the second position.

Another embodiment relates to a coaxial cable connector configured to connect a coaxial cable to a mating connector, the coaxial cable connector comprising a connector body having a forward end and a rearward end opposite the forward end, the rearward end configured to receive a coaxial cable; a nut coupled to the forward end of the body and configured to engage the mating connector; an annular post disposed within the connector body; and a sleeve received within the connector body and movable from a first position to a second position, the sleeve comprising first and second annular sidewalls; wherein the first and second annular sidewalls are configured to deform radially inward and form a forward-tilting grasping member as the sleeve is moved from the first position to the second position; and wherein the grasping member is configured to provide a compressive force on the coaxial cable.

Another embodiment relates to a method of assembling a coaxial cable connector to a coaxial cable, the coaxial cable connector comprising a body, a post provided within the body, and a sleeve extending from a rearward portion of the body, the coaxial cable comprising an inner conductor, an insulator surrounding the inner conductor, an outer conductor surrounding the insulator, and an outer jacket, the method comprising inserting the cable into a rearward portion of the connector such that the inner conductor and insulator are received within the post and the outer conductor and jacket are received within an annular bore between the post and the body; and moving the sleeve axially forward within the body from a first position to a second position to asymmetrically collapse a collapsible portion of the sleeve; wherein the sleeve forms a forward-tilting projection in the second position, the projection configured to provide a compressive force on the jacket and retain the cable within the connector.

DETAILED DESCRIPTION OF EXEMPLARY EMBODIMENTS

Figure 1A:
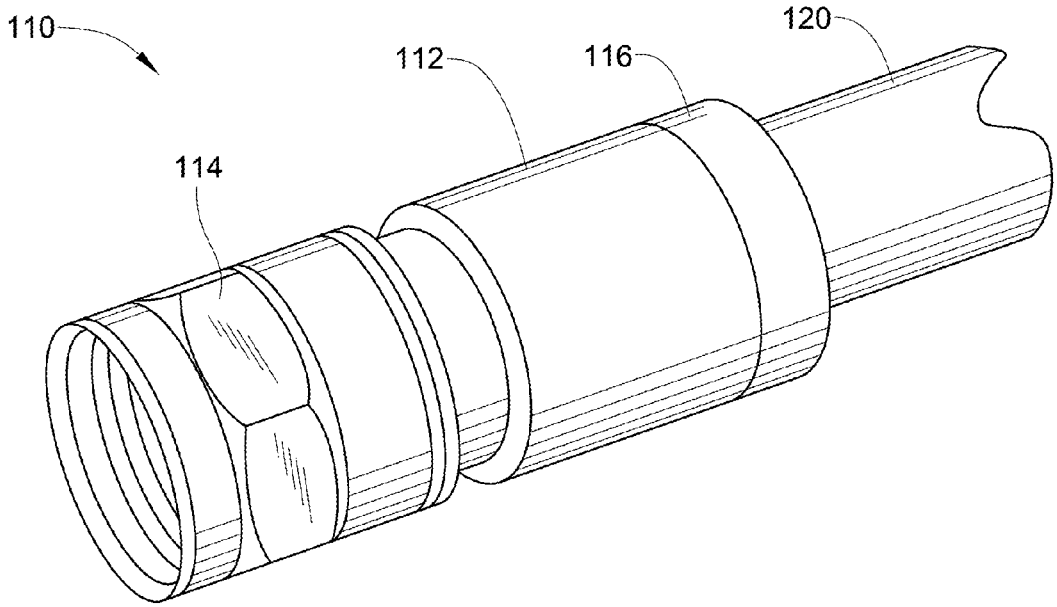
FIG. 1A is a perspective view of a coaxial cable connector according to an exemplary embodiment.

Referring to the FIGURES generally, coaxial cable connectors typically include a connector body (e.g., an annular collar) for accommodating a coaxial cable. An annular nut may be rotatably connected to the body for providing mechanical attachment of the connector to an external device (e.g., a mating connector). An annular post may be coupled to the body. The nut may include a threaded portion or other attachment feature that enables attachment of the connector to a mating connector or other device. The body includes a rearward portion configured to receive the coaxial cable. The connector may further include a locking sleeve or other component intended to facilitate retention of the cable within the connector.

Various embodiments disclosed herein relate to a locking sleeve or related components that are usable to secure a coaxial cable within a coaxial cable connector. More specifically, a collapsible or deformable sleeve or similar component may be utilized such that upon fully inserting the sleeve into the connector body, at least a portion of the sleeve collapses or deforms toward the outer surface of the coaxial cable and/or a forward portion of the connector (e.g., at a forward tilt angle), thereby providing a compressive retention force for securing the cable within the connector, and providing a seal to prevent unwanted moisture or other materials from entering the interior of the coaxial cable connector.

Referring now to FIG. 1A-1F, a coaxial cable connector 110 is shown according to an exemplary embodiment. Connector 110 is configured to be assembled onto a coaxial cable 120, and includes a connector body 112 (e.g., a collar, body portion, etc.), a nut 114 (e.g., a threaded nut, etc.), and a sleeve 116 (e.g., a locking sleeve, a collapsible and/or compressible member, etc.). Connector 110 further includes a post 118 provided within one or more of body 112, nut 114, and sleeve 116 (see FIG. 2A). Connector 110 may include one or more sealing members, shown as o-rings 122, 124 (e.g., elastomeric o-rings, etc.), for preventing moisture or other undesirable materials from entering the interior of connector 110.

According to one embodiment, connector body 112 is a generally cylindrical member having a first, or front end 126, a second, or rear end 128, an outer surface 130, an inner surface 132, and an inner bore 134 extending through body 112. Body 112 may be made of a suitable metal (e.g., brass, etc.) or other material, including non-metals, and may be cast, molded, cold headed, or made using a different process. Body 112 further includes a shoulder portion 136 and a rear flange, or lip 138. In one embodiment, shoulder portion 136 acts as a stop to define a forward limit of axial movement of sleeve 116. While shoulder portion 136 is shown in FIGS. 1B-1C as being defined by two wall portions of body 112, other configurations for shoulder portion 136 may be used according to various alternative embodiments. Lip 138 acts to retain at least a portion of sleeve 116 within body 112.

As shown in FIGS. 1B-1C, the inner and/or outer diameters of body 112 may vary along the length of body 112. For example, forward end 126 of body 112 has a relatively smaller inner diameter to provide a proper fit (e.g., an interference fit, a snap fit, etc.) with post 118. Between forward end 126 and rearward end 128, body 112 may have a tapered inner diameter to provide a proper fit for receiving an exterior jacket, shield, or other components of cable 120 between body 112 and post 118. Rearward end 128 of body 112 may have a relatively larger inner diameter to accommodate sleeve 116 and cable 120.

According to an exemplary embodiment, nut 114 includes a front portion 140 and a rear portion 142. Nut 114 may be made of a metal or other suitable material. Front portion 140 may include a threaded internal surface 146 configured to provide a threaded engagement with a mating connector (e.g., a port connector, etc.) or other device (not shown). In alternative embodiments, nut 114 may provide other types of interfaces with mating connectors. Rear portion 142 of nut 114 may include an inwardly-extending annular flange 144 configured to maintain nut 114 in proper position relative to body 112 and/or post 118 such that nut 114 is rotatably coupled to body 112 and/or post 118.

According to an exemplary embodiment, post 118 includes flanged base portion 150, a radially enlarged portion 152 from which flanged base portion 150 extends, and a generally tubular cylindrical portion 154 extending in a rearward direction from enlarged portion 152 and defining an inner bore 158 therethrough. Post 118 may be made of a metal or other suitable material. One or more annular barbs 160 (e.g., projections, serrations, etc.) may extend from an outer surface of post 118 and be configured to improve retention of cable 120 within connector 110. Post 118 is configured to receive an inner conductor and insulator of cable 120 within inner bore 158, such that the outer conductor and/or jacket of cable 120 are positioned between post 118 and body 112 and/or sleeve 116.

According to an exemplary embodiment, sleeve 116 includes a front portion 162, a rear portion 164, an outer surface 166, and an inner surface 168. Sleeve 116 may be made from a deformable and/or collapsible material such as a plastic or another suitable material, and may be machined, injection molded, or made using a different process. In one embodiment sleeve 116 is made from acrylonitrile butadiene styrene (ABS), although other polymers and/or similar materials may be used according to various other embodiments. Sleeve 116 is configured to be moveable from a first position, as shown in FIG. 1B (e.g., a pre-assembly, or unassembled, position), where sleeve 116 may be separated, or detached, from body 112 to facilitate assembly of connector 110, to a second position, as shown in FIG. 1C (e.g., a post-assembly, or assembled, position), where sleeve 116 may be retained within body 112 in a more secure, or permanent, fashion. At least a portion of outer surface 166 of sleeve 116 may slidably engage inner surface 132 of body 112. Further, sleeve 116 and body 112 may be provided with corresponding interfacing features (e.g., indents/detents, projections/recesses, etc.) configured maintain sleeve 116 in the first and/or second positions. For example, in one embodiment, a first detent 176 on sleeve 116 engages lip 138 on body 112 to detachably or separably retain sleeve 116 in the first position, and after movement of sleeve 116 from the first position to the second position, a second detent 178 on sleeve 116 engages lip 138 on body 112 to retain sleeve 116 in the second position. Sleeve 116 may further include one or more recesses to receive lip 138 to facilitate retention of sleeve 116. For example, a recess 180 may receive lip 138 in the second position.

Figure 1B:
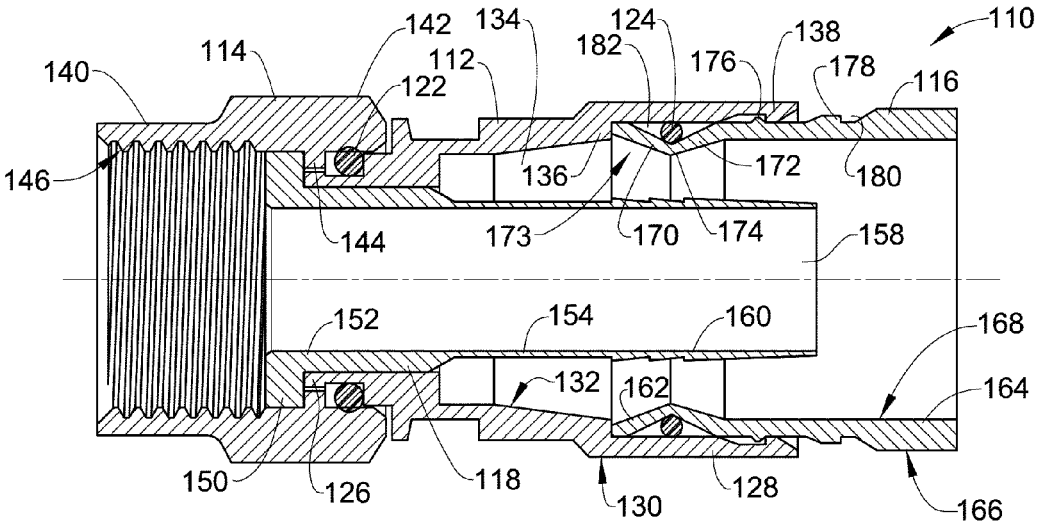
FIG. 1B is a cross-sectional view of the coaxial cable connector of FIG. 1A in a first position according to an exemplary embodiment.
Figure 1C:
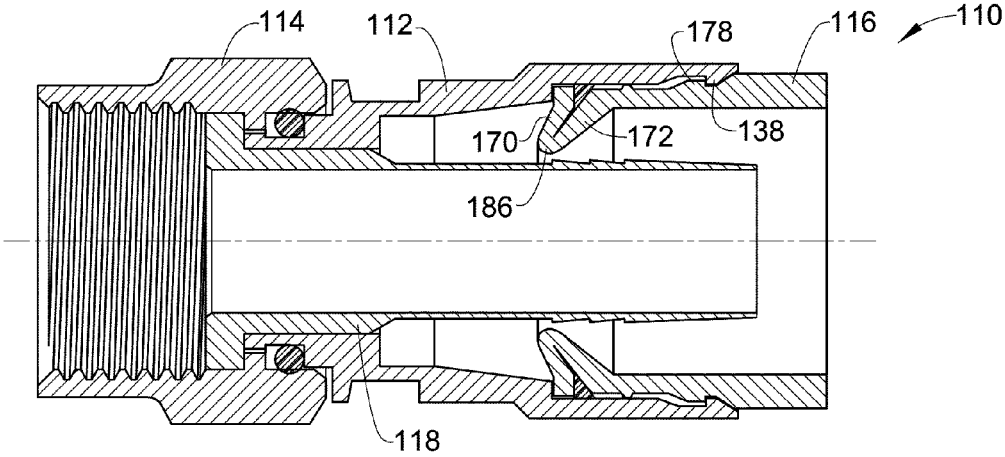
FIG. 1C is a cross-sectional view of the coaxial cable connector of FIG. 1A in a second position according to an exemplary embodiment.
Figure 1D:
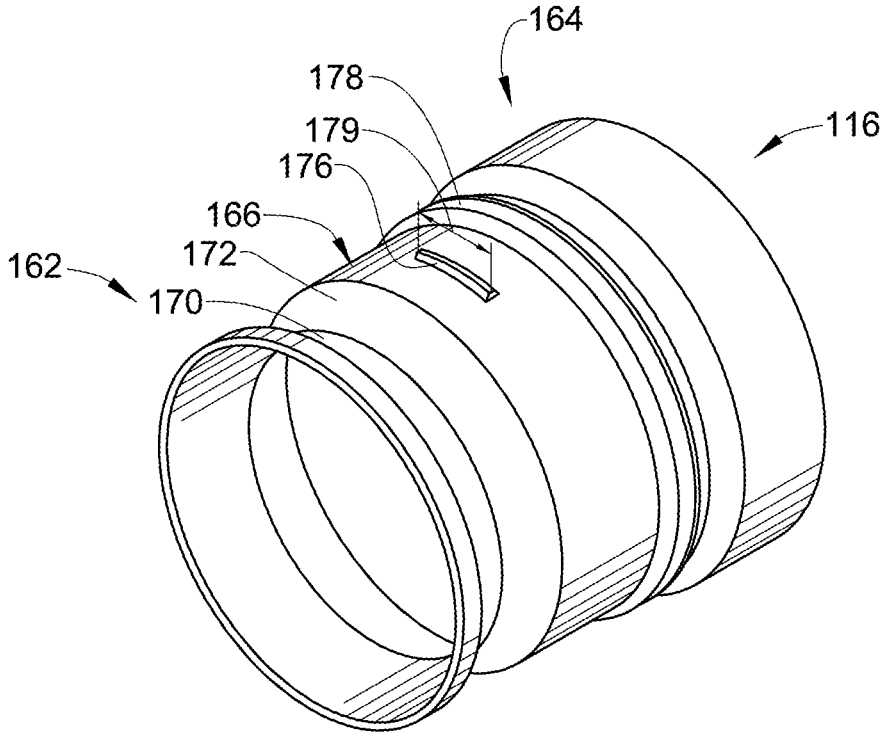
FIG. 1D is a perspective view of a locking sleeve usable with the coaxial cable connector of FIG. 1A according to an exemplary embodiment.
Figure 1E:
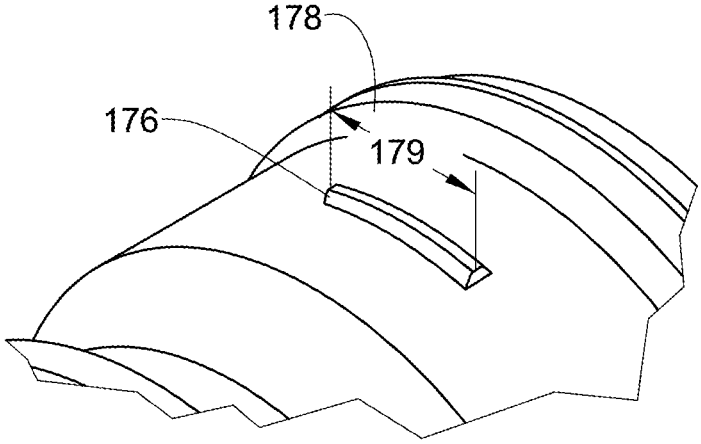
FIG. 1E is an enlarged partial perspective view of the locking sleeve of FIG. 1D according to an exemplary embodiment.

As shown in FIGS. 1D-1E, detents 176 may be provided along a portion of the perimeter of outer sleeve 116. For example, in one embodiment, two detents 176 are provided at substantially opposite locations on sleeve 116, and each detent 176 extends for a length 179 (e.g., 0.100 in., more or less than 0.100 in., etc.). Each detent 176 may include chamfered, or beveled surfaces to facilitate movement and/or removal/detachment/separation of sleeve 116 from body 112, while maintaining sleeve 116 retained at least partially within body 112 when desired. According to various alternative embodiments, the size, shape, and number of detents 176 may be varied. For example, detents 176 may be "higher" or "lower" relative to outer surface 166 of sleeve 116, more or fewer detents may be utilized (e.g., 1, 3, 4, etc.), detents 176 may be equally or unequally distributed about the perimeter of sleeve 116, and so on. Detent 178, while shown as a continuous annular member, may likewise include discrete portions about sleeve 116 and may similarly vary in size, shape, number, and location. All such variations are understood to be within the scope of the present disclosure.

It should be noted that while FIGS. 1A-1B show a specific configuration of corresponding features (e.g., lip 138 and detents 176, 178) for retaining sleeve 116 in the first and/or second position, other features may be utilized (e.g., other recesses, projections, friction fits, snap fits, etc.), and the relative positions of the features may be reversed. For example, in some embodiments, the rearmost end of body 112 and recess 180 on sleeve 116 may define complementary angled surfaces (e.g., each provided at an angle of 30 degrees, 60 degrees, etc. from horizontal). All such features and combinations of features are within the scope of the present disclosure.

Referring further to FIGS. 1B and 1C, according to an exemplary embodiment, sleeve 116 includes a collapsible portion 173 (e.g. a thin-walled portion, a compressible portion, a deformable portion, etc.) having a first annular sidewall 170 and a second annular sidewall 172 coupled via an annular joint 174. According to an exemplary embodiment, first and second sidewalls 170, 172 are annular sidewalls configured to collapse, or deform, upon an axial force being applied to sleeve 116 and sleeve 116 being moved from the first position to the second position. Joint 174 may provide a relatively smooth transition between first and second sidewalls 170, 172, or alternatively, may include a notch, relief, or similar feature to facilitate proper collapsing and/or deformation of first and second sidewalls 170, 172.

In some embodiments, first and second sidewalls 170, 172 are asymmetric about joint 174. In other words, first and second sidewalls 170, 172 may not be mirror images of each other about joint 174. For example, in some embodiments, second sidewall 172 may be relatively longer and/or thicker (e.g. in the radial direction) than first sidewall 170. Further, first and second sidewalls 170, 172 may form an asymmetric "V"-shape (e.g., a V-shape having unequal leg lengths, or having legs extending relative to a horizontal surface at differing angles). For example, in one embodiment, the portion of inner surface 132 extending from shoulder 136 may define a generally cylindrical surface, and first and second sidewalls 170, 172 may form differing angles with the cylindrical surface (which may or may not completely coincide with inner surface 132 of body 112). In some embodiments, first sidewall 170 may form approximately a 20 degree angle with the cylindrical surface, while second sidewall 172 may form approximately a 15 degree angle with the cylindrical surface. According to various other embodiments, first and second sidewalls 170, 172 may be positioned at differing relative angles (e.g., at angles more or less than 20 degrees and 15 degrees, respectively, etc.).

In some embodiments, the outer surfaces of first and second sidewalls 170, 172 form a first annular V-shape, and the inner surfaces of first and second sidewalls 170, 172 form a second annular V-shape, when sleeve 116 is in the first position. Joint 174 (e.g., the apex of the V-shape) may define the smallest inner diameter of sleeve 116 in the first position and/or the second position. This may provide for a relatively larger opening at rear portion 164 of sleeve 116 and facilitate guiding cable 120 into connector 110. In some embodiments, a space 182 is defined by outer surface 166 of sleeve 116 and inner surface 132 of body 112, and a sealing member, such as o-ring 124, is provided in space 182 so as to ensure that a sufficient seal (e.g., a moisture seal, etc.) is formed annularly between sleeve 116 and body 112. Alternatively, o-ring 124 may be omitted such that sleeve 116 may be coupled to body 112 without the use of o-rings. The V-shaped construction of first and second sidewalls 170, 172 may provide a more controlled and uniform collapse of collapsible portion 173 and reduce the axial compressive force required to move sleeve 116 from the first position to the second position.

Referring further to FIG. 1B, connector 110 is shown in the first position configured to receive a coaxial cable (e.g., cable 120 shown in FIG. 1A). As shown in FIG. 1B, sleeve 116 is positioned at least partially within body 112. A front portion 162 of sleeve 116 is positioned adjacent shoulder 136 of body 112. Shoulder 136 acts as a stop to limit forward axial movement of sleeve 116. Shoulder 136 may be provided at any suitable location along inner surface 132 of body 112 to enable proper movement and retention of sleeve 116. When sleeve 116 is in the first position, cable 120 may be inserted through rear portion 164 of sleeve 116 such that the inner conductor and insulator of cable 120 are received within inner bore 158 of post 118, and the outer conductor and/or jacket of cable 120 are positioned between post 118 and body 112 and/or sleeve 116.

Referring to FIG. 1C, with cable 120 (not shown) properly seated within connector 112, sleeve 116 may be moved axially (e.g. linearly) to the second position. In some embodiments, a tool may be utilized to provide an axial compressive force sufficient to move sleeve 116 from the first position to the second position. As sleeve 116 moves from the first position to the second position, shoulder 136 on body 112 limits forward axial movement of sleeve 116, causing first and second sidewalls 170, 172 to "collapse," and move radially inward such that they form a grasping member 186 (e.g., a barb, projection, etc.) in the second position. Grasping member 186 may be sized and shaped such that the outer conductor and/or outer jacket of cable 120 are radially compressed between grasping member 186 and post 118. Further, grasping member 186 is configured such that in the second position, an appropriate seal (e.g., a moisture seal, etc.) is formed between grasping member 186 and the outer jacket of cable 120 (e.g., to ensure that unwanted moisture, particles, etc. do not enter the interior of connector 110).

According to an exemplary embodiment, first and second sidewalls 170, 172 form grasping member 186 such that grasping member 186 has a forward tilt (see FIG. 1C). In other words, rather than grasping member 186 being directed radially straight inward (e.g., substantially perpendicular to a longitudinal axis of connector 110) grasping member 186 is formed such that it is directed in both a radially inward direction and a forward direction. Providing a grasping member such as grasping member 186 may increase the retention force of connector 110 relative to purely inward-directed grasping members or rearward-tilted retention members, and permit the use of lower profile barbs on post 118 to reduce the insertion forces required to assemble connector 110.

Figure 1F:
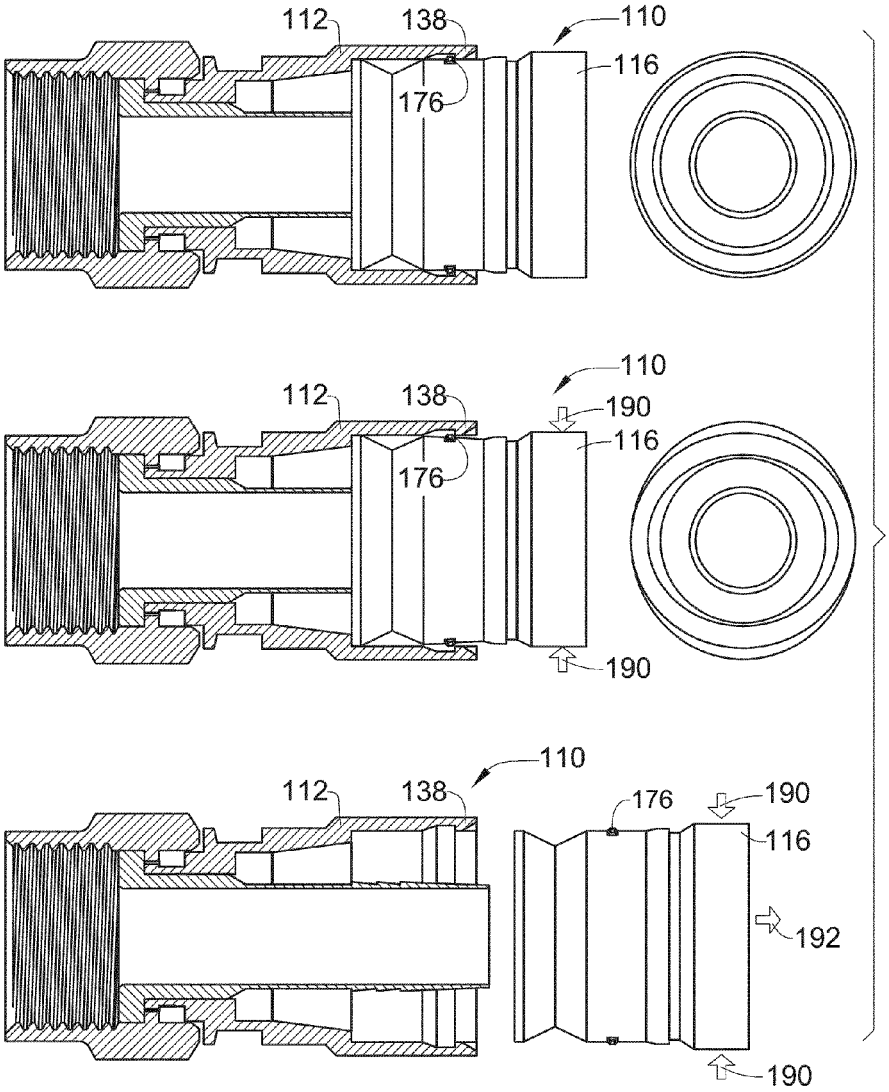
FIG. 1F illustrates the steps of detaching a locking sleeve from a coaxial cable connector according to an exemplary embodiment.

Referring to FIG. 1F, in some embodiments, sleeve 116 may be detachable from body 112 in the first and/or second position. For example, in the first position, detents 176 on sleeve 116 interface with lip 138 on body 112 to retain sleeve 116 in the first position. To detach sleeve 116, sleeve 116 may be compressed (e.g., deformed, elongated, etc.) by application of a compressive force applied to opposite "sides" of sleeve 116 corresponding to the locations of detents 176. For example, a compressive force may be applied as shown by arrows 190 in FIG. 1F. Upon application of the compressive force, detents 176 move radially inward relative to lip 138 such that sleeve 116 may be removed from body 112 in the direction of arrow 192 shown in FIG. 1F. Sleeve 116 may be re-attached to body 112 in a similar fashion. Upon movement from the first position to the second position, detent 178 engages lip 138, and may provide a more secure, or permanent interface than detent 176 to maintain sleeve 116 in the second position.

The coaxial cable connectors shown in FIG. 1A-1F and elsewhere herein may provide various advantages over more conventional coaxial cable connectors. For example, because of the asymmetric collapsing features (e.g., providing a forward tilt to the collapsing portion), a "barb shaped" crimp is formed to "bite" into the cable and provide higher retention forces than more conventional connectors that may provide only a radially inward force. Such features may permit the use of fewer barbs, lower profile barbs, or even no barbs on the post. Using fewer, lower profile, or no barbs may reduce the insertion forces required to insert the cable into the connector (e.g., requiring a "cable-to-connector" insertion force of 20 pounds or less) and reduce tool compressive forces required to fully assemble the connector. Further, utilizing a plastic sleeve may be more cost-effective than using metal components, and a plastic sleeve utilizing a snap fit type interface with the connector body (e.g., for transit, etc.) may allow for greater part tolerances and further cost reductions. Furthermore the "space" formed between the collapsible portion and the body is sealed, preventing moisture and/or other unwanted materials from interfering with the operation of the connectors (e.g., in contrast to connectors which may have certain features exposed and more susceptible to interference from unwanted materials, moisture, etc.). Further yet, utilizing a snap fit between the sleeve and connector body is more cost effective relative to other fastening means such as press-fitting, threaded engagement, etc.

Additionally, other advantages may be provided, such as minimizing "blind entry" of the cable end into the post due to at least a portion of the sleeve being captured within the body even in the unassembled (e.g., first) position. The detachable feature of the sleeve may also facilitate assembly of the connector. Further, the sealing features of the connector may improve the electrical, mechanical, and environmental properties and provide for increased cable retention and minimized moisture migration.

Figure 2A:
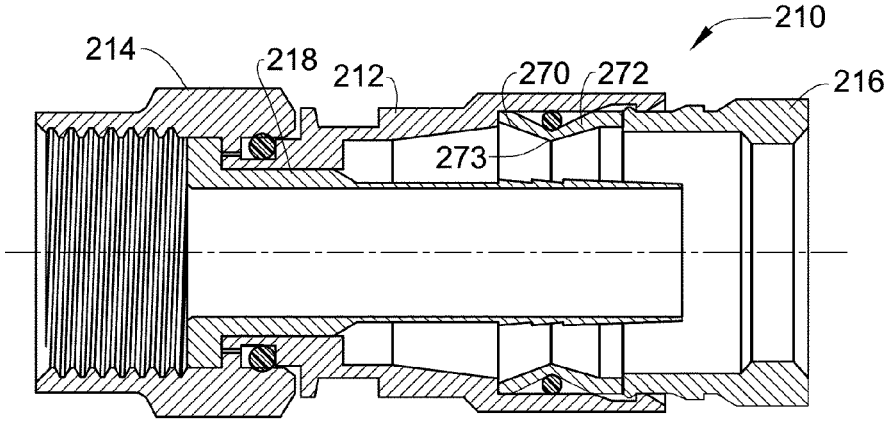
FIG. 2A is a cross sectional view of a coaxial cable connector in a first position according to another exemplary embodiment.
Figure 2B:
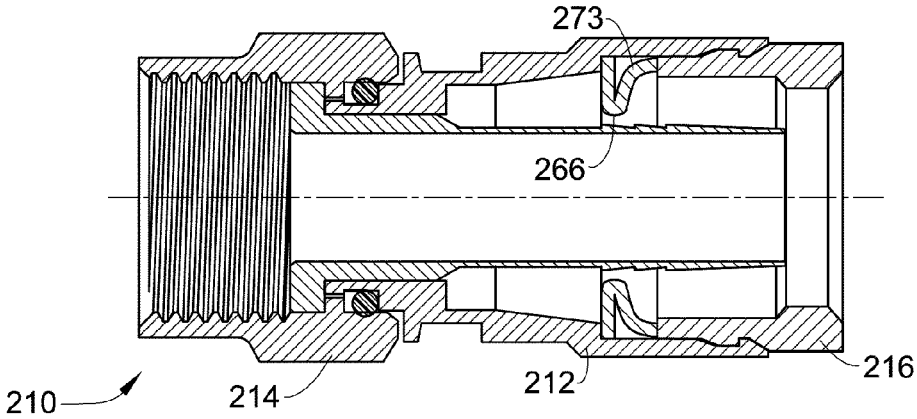
FIG. 2B is a cross-sectional view of the coaxial cable connector of FIG. 2A in a second position according to another exemplary embodiment.
Figure 2C:
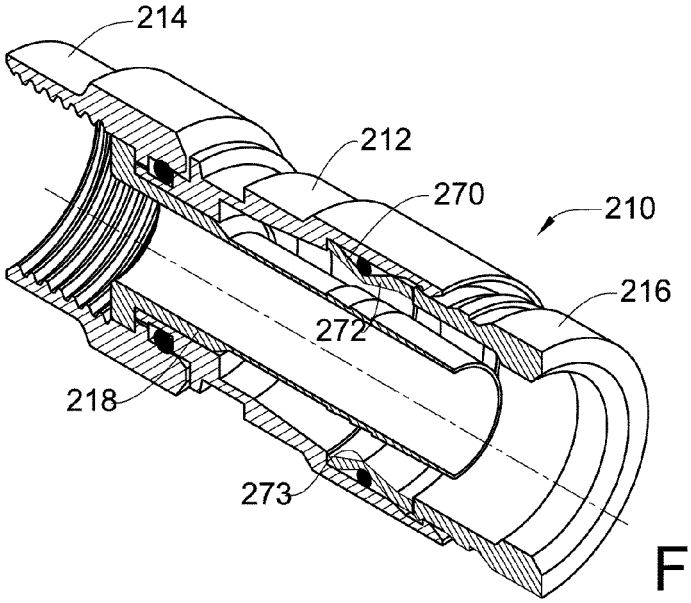
FIG. 2C is a cross-sectional perspective view of the coaxial cable connector of FIG. 2A according to another exemplary embodiment.

Referring now to FIGS. 2A-2C, a coaxial cable connector 210 is shown according to an exemplary embodiment. As shown in FIGS. 2A-2C, connector 210 includes a body 212, a nut 214, a sleeve 216, and a post 218. According to an exemplary embodiment, sleeve 216 may be a noncollapsible member provided rearward of a separate collapsible member 273. In some embodiments, sleeve 216 may be made of acetal or another suitable material (e.g., Delrin), and collapsible member 273 may be made of ABS or another suitable material.

As shown in FIGS. 2A-2C, collapsible member 273 includes first and second sidewalls 270, 272 coupled together. Axial compressive forces applied to sleeve 216 are transmitted to collapsible member 273 such that first and second sidewalls 270, 272 collapse to form a grasping member 286 in a similar fashion to the formation of grasping member 186 shown in FIGS. 1B-1C.

Figure 3A:
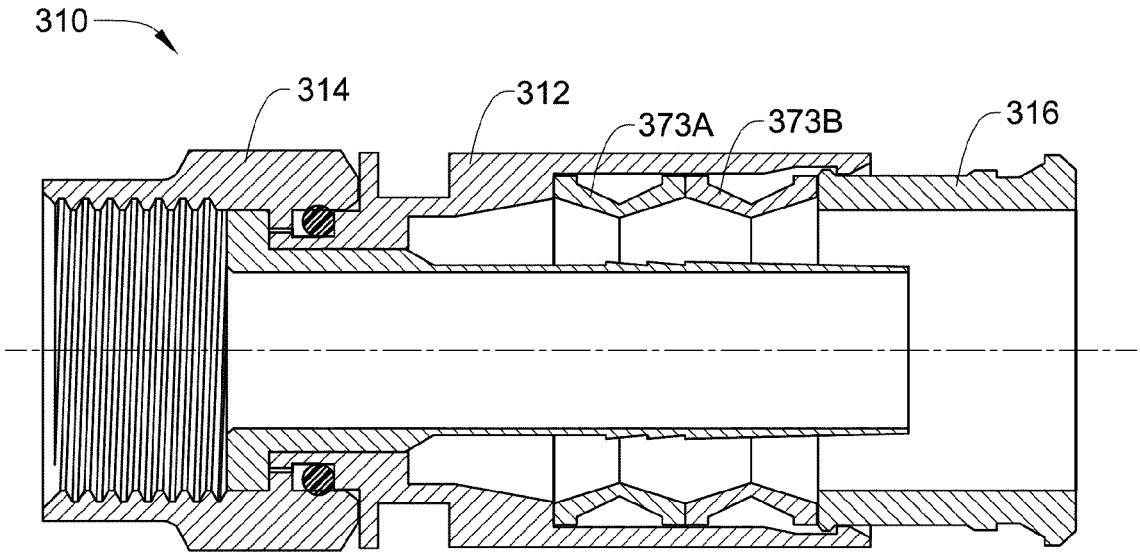
FIG. 3A is a cross-sectional view of a coaxial cable connector in a first position according to another exemplary embodiment.
Figure 3B:
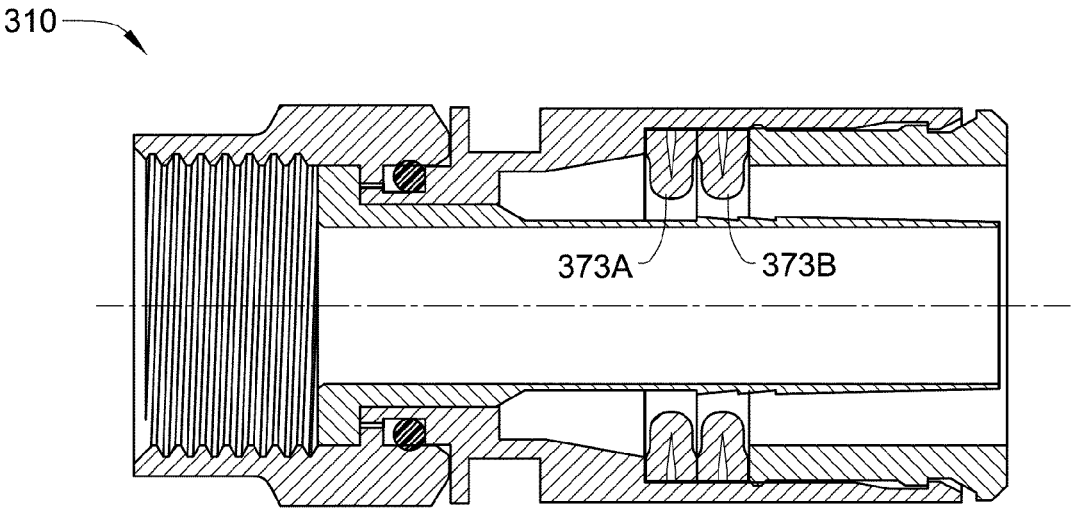
FIG. 3B is a cross-sectional view of the coaxial cable connector of FIG. 3A in a second position according to another exemplary embodiment.
Figure 3C:
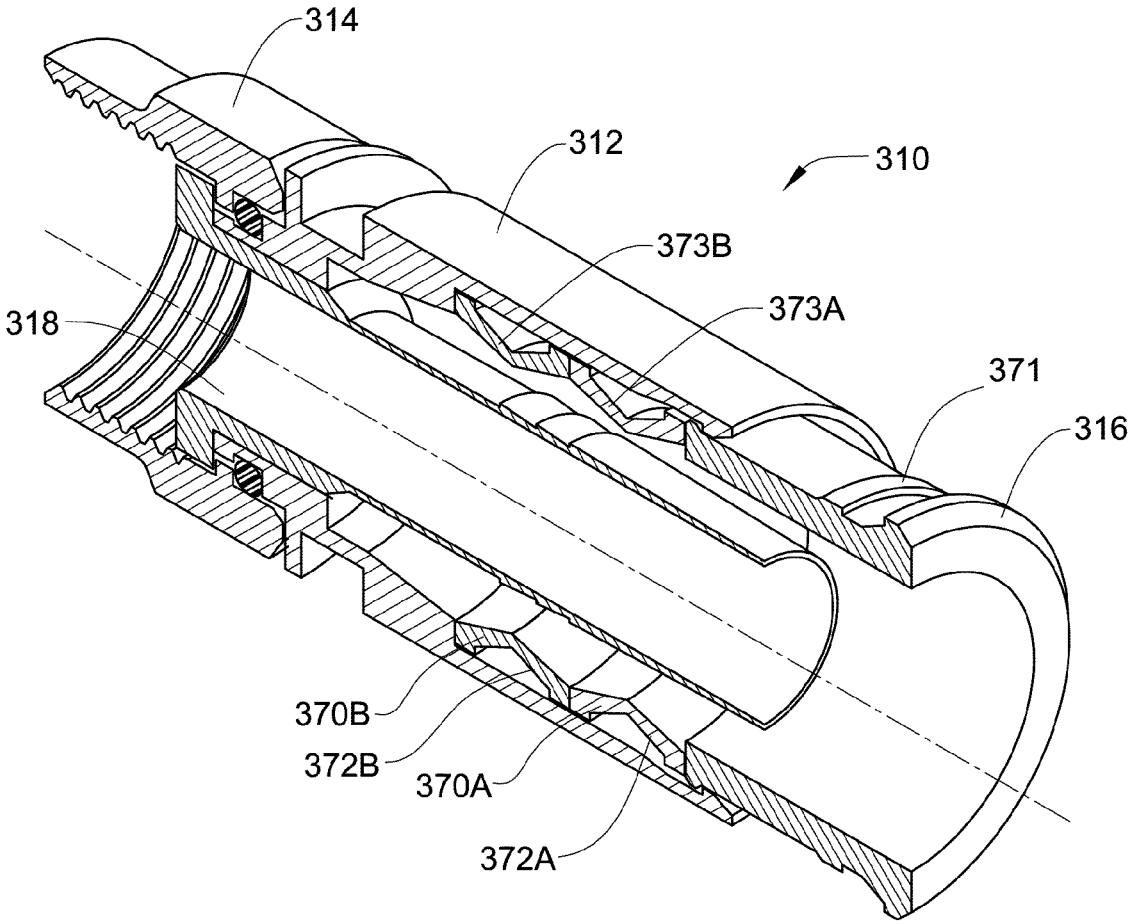
FIG. 3C is a cross-sectional perspective view of the coaxial cable connector of FIG. 3A according to another exemplary embodiment.

Referring to FIGS. 3A-3C, a coaxial cable connector 310 is shown according to an exemplary embodiment. According to an exemplary embodiment, connector 310 includes a body 312, a nut 314, a sleeve 316, and a post 318. In some embodiments, connector 310 further includes two collapsible members 373A and 373B. A first collapsible member 373A includes first and second sidewalls 370A, 372A, and a second collapsible member 373B includes first and second sidewalls 370B and 372B. Collapsible members 373A, 373B are collapsible and/or deformable to form first and second grasping members 386A, 386B when sleeve 316 is moved from a first position (FIG. 3A) to a second position (FIG. 3B). While FIGS. 3A-3C illustrate two collapsible members utilized in connection with connector 310, according to various alternative embodiments, more than two collapsible members (e.g., 3, 4, etc.) may be utilized. Using multiple collapsible members (and, therefore, multiple grasping members) may increase the retention capabilities of connector 310.

Figure 4A:
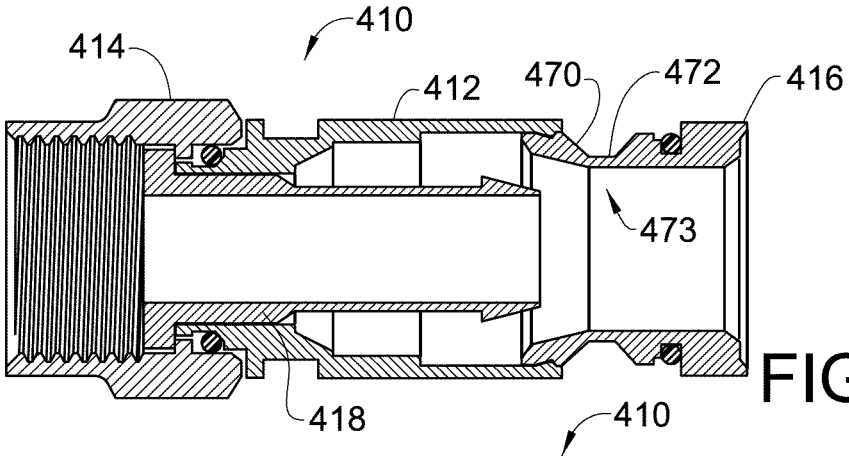
FIG. 4A is a cross-sectional view of a coaxial cable connector in a first position according to another exemplary embodiment.
Figure 4B:
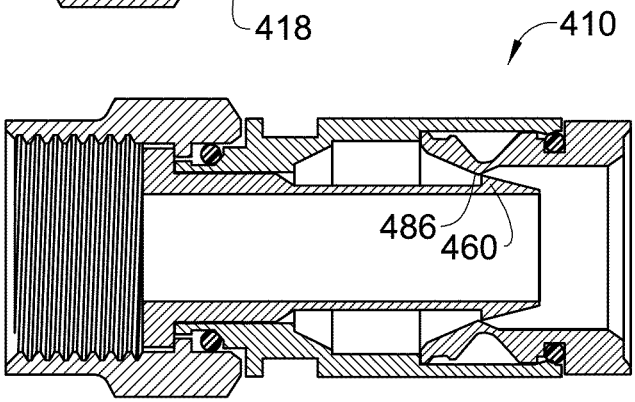
FIG. 4B is a cross-sectional view of the coaxial cable connector of FIG. 4A in a second position according to another exemplary embodiment.

Referring to FIGS. 4A-4B, a coaxial cable connector 410 is shown according to an exemplary embodiment. According to an exemplary embodiment, connector 410 includes a body 412, a nut 414, a sleeve 416, and a post 418. Sleeve 416 includes a collapsible portion 473 having first and second sidewalls 470, 472 that are coupled together and collapsible and/or deformable to form a grasping member 486. As shown in FIG. 4A, first sidewall 470 may be relatively thicker than second sidewall 472 and/or have a tapered profile, and second sidewall 472 may be of generally uniform thickness. In some embodiments, collapsible portion 473 and post 418 may be configured such that upon movement of sleeve 416 from a first position (shown in FIG. 4A) to a second position (shown in FIG. 4B), grasping member 486 is generally axially aligned with one or more barbs 460 extending from post 418. As such, in the second position, grasping member 486 and barb 460 are configured to apply a compressive retention force upon an outer conductor and/or an outer jacket of a cable such as cable 120 extending therebetween.

Figure 5A:
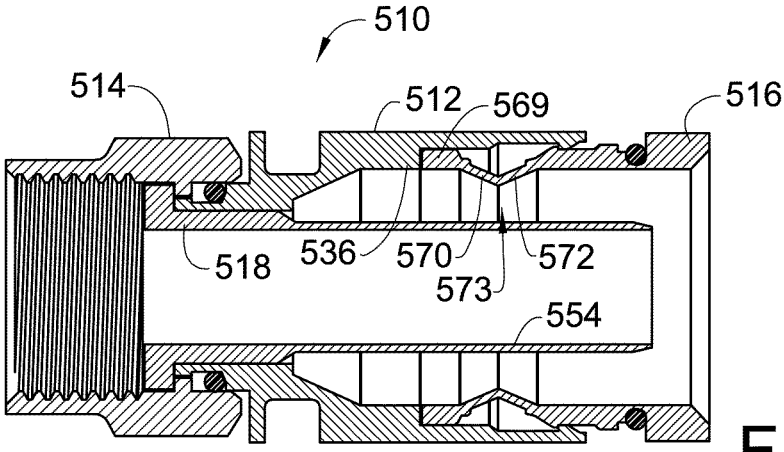
FIG. 5A is a cross-sectional view of a coaxial cable connector in a first position according to another exemplary embodiment.
Figure 5B:
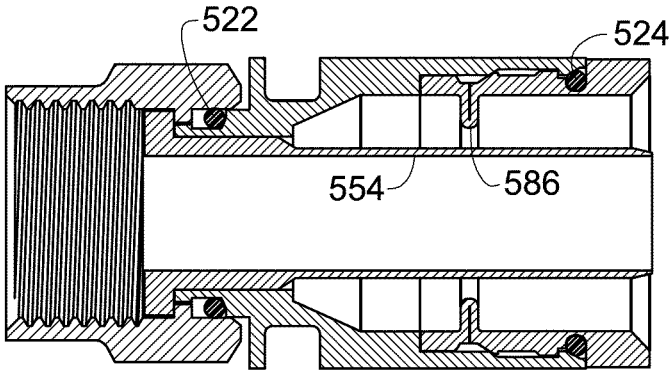
FIG. 5B is a cross-sectional view of the coaxial cable connector of FIG. 5A in a second position according to another exemplary embodiment.

Referring to FIGS. 5A-5B, a coaxial cable connector 510 is shown according to an exemplary embodiment. According to an exemplary embodiment, connector 510 includes a body 512, a nut 514, a sleeve 516, and a post 518. Sleeve 516 includes a collapsible portion 573 having first and second sidewalls that are collapsible and/or deformable radially inward to form a grasping member 586. Grasping member 586 may extend generally straight radially inward, or alternatively, may have a forward tilt. In some embodiments, first and second sidewalls 570, 572 may each be of generally the same uniform thickness. Alternatively first and second sidewalls 570, 572 may have differing and/or non-uniform thicknesses. A forward portion 569 may be provided adjacent first sidewall 570 and be configured to engage shoulder 536 of body 512.

According to an exemplary embodiment, post 518 includes a generally cylindrical portion 554. It should be noted that in contrast to various other embodiments illustrated herein, cylindrical portion 554 may be provided without any exterior barbs (e.g., such as barb 460 shown in FIG. 4) such that the outer surface of post 518 may be free of projections, etc. Providing a post such as post 518 free of barbs or other surface irregularities may reduce the insertion force required to properly insert cable 120 within connector 510.

Figure 6A:
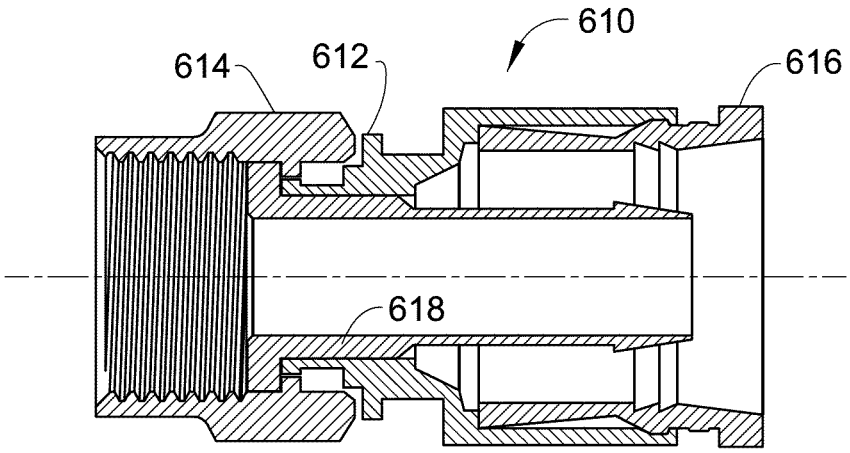
FIG. 6A is a cross-sectional view of a coaxial cable connector in a first position according to another exemplary embodiment.
Figure 6B:
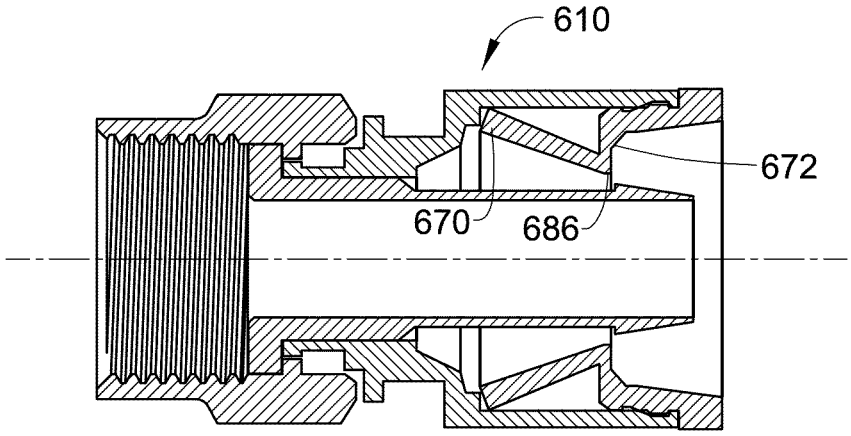
FIG. 6B is a cross-sectional view of the coaxial cable connector of FIG. 6A in a second position according to another exemplary embodiment
Figure 6C:
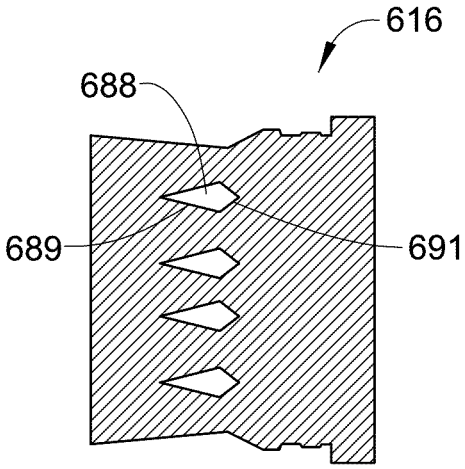
FIG. 6C is a side view of a sleeve usable with the coaxial cable connector of FIG. 6A according to an exemplary embodiment.

Referring to FIGS. 6A-6C, a coaxial cable connector 610 is shown according to an exemplary embodiment. According to an exemplary embodiment, connector 610 includes a body 612, a nut 614, a sleeve 616, and a post 618. Sleeve 616 may include first and second sidewalls 670, 672 that are collapsible and/or deformable to form a grasping member 686. In one embodiment, first sidewall 670 is relatively longer than second sidewall 672, such that upon movement of sleeve 616 from a first position (see FIG. 6A) to a second position (se FIG. 6B) second sidewall 672 extends substantially straight radially inward. In other embodiments, second sidewall 672 may have a forward or rearward tilt in the second position.

Referring to FIG. 6C, according to an exemplary embodiment, sleeve 616 may include a number of apertures 688 (e.g., slots, holes, etc.) Apertures 688 may be provided about all or a portion of sleeve 616 (e.g., in an annular fashion), and may take a variety of shapes and sizes. According to an exemplary embodiment, apertures 688 are diamond-shaped having a pair of longer sides 689 and a pair of shorter sides 691. According to various alternative embodiments, other shapes or sizes may be used on connection with apertures 688.

Figure 7:
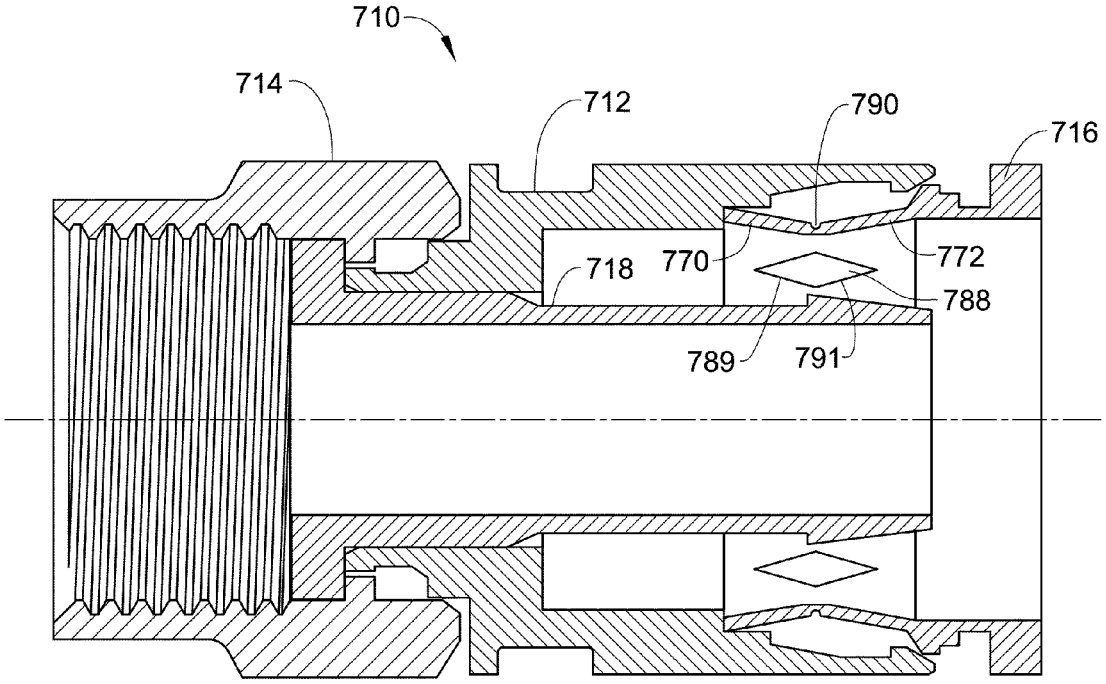
FIG. 7 is a cross-sectional view of a coaxial cable connector according to another exemplary embodiment.

Referring to FIG. 7, a coaxial cable connector 710 is shown according to an exemplary embodiment. According to an exemplary embodiment, connector 710 includes a body 712, a nut 714, a sleeve 716, and a post 718. Sleeve 716 may include first and second sidewalls 770, 772 that are joined at an annular notch 790 (e.g., a recess, etc.). Any suitable shape and size may be used for notch 790 (e.g., a U-shaped annular notch, a V-shaped annular notch, etc.) Notch 790 is configured to facilitate collapsing and/or deformation of first and second sidewalls 770, 772 upon application of an axial force to sleeve 716 to move sleeve 716 from a first (unassembled) position to a second (assembled) position. Sleeve 716 may further include apertures 788 similar to apertures 688 shown in FIG. 6, except apertures 788 may have sides 789 and 791 of generally equal length. In some embodiments, first and second sidewalls 770, 772 may be of generally equal length and thickness, while in alternative embodiments, first and second sidewalls 770, 772 may have differing lengths and/or thicknesses.

Figure 8A:
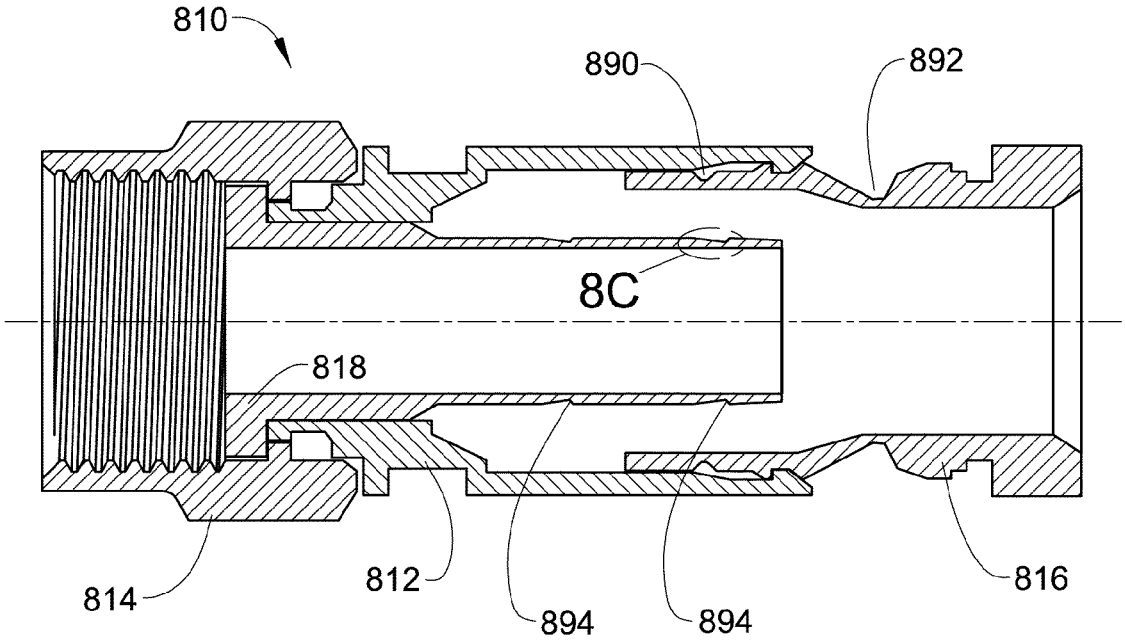
FIG. 8A is a cross-sectional view of a coaxial cable connector in a first position according to another exemplary embodiment.
Figure 8B:
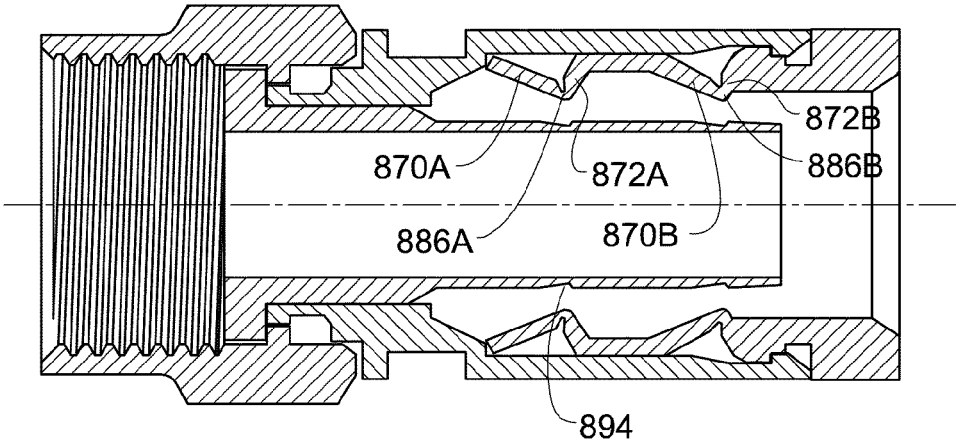
FIG. 8B is a cross-sectional view of the coaxial cable connector of FIG. 8A in a second position according to another exemplary embodiment.
Figure 8C:
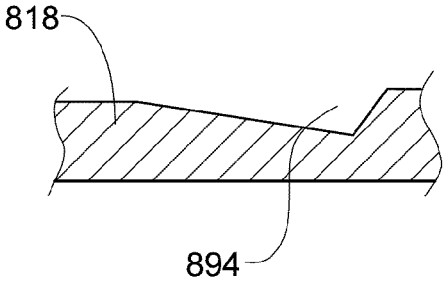
FIG. 8C is a detail view of a portion of a post usable with the coaxial cable connector of FIG. 8A according to an exemplary embodiment.

Referring to FIGS. 8A-8C, a coaxial cable connector 810 is shown according to an exemplary embodiment. According to an exemplary embodiment, connector 810 includes a body 812, a nut 814, a sleeve 816, and a post 818. Sleeve 816 includes thin-walled portions 890, 892 (e.g., areas having relatively thinner material thickness than the surrounding portions of sleeve 816) that collapse radially inward to provide grasping members 886A, 886B between first sidewalls 870A, 870B and second sidewalls 872A and 872B when sleeve 816 is moved from a first position (see FIG. 8A) to a second position (see FIG. 8B).

According to an exemplary embodiment, post 818 includes one or more annular reliefs, or recesses 894 that generally align with grasping members 886A and 886B when sleeve 816 is in the second position. Reliefs 894 may improve the cable retention capabilities of connector 810. According to an exemplary embodiment, relief 894 is in the form of an annular serration extending into post 818 (see FIG. 8C). Other shapes and sizes may be used for reliefs 894, and the placement, number, and configuration of reliefs 894 may be varied according to various alternative embodiments.

Figure 9A:
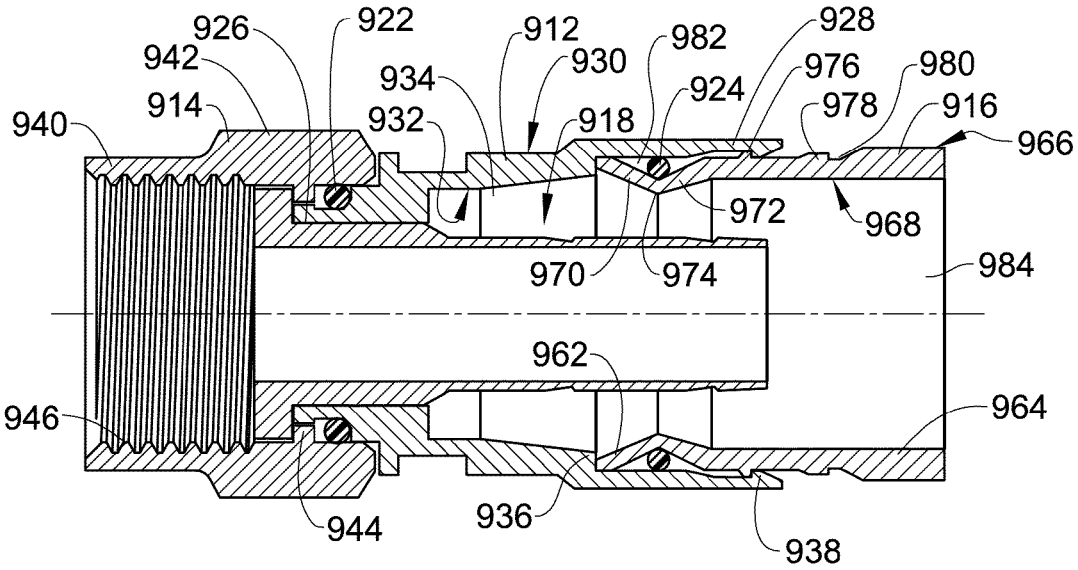
FIG. 9A is a cross section view of a coaxial cable connector is a first position according to another exemplary embodiment.
Figure 9B:
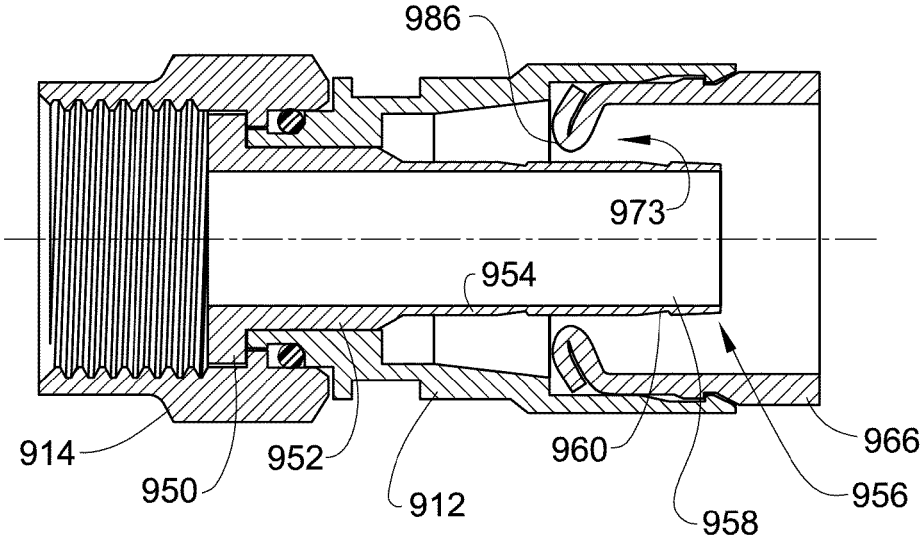
FIG. 9B is a cross-section view of the coaxial cable connector of FIG. 9A in a second position according to an exemplary embodiment.

Referring to FIGS. 9A-9B, a coaxial cable connector 910 is shown according to an exemplary embodiment. Connector 910 includes a body 912, a nut 914, a sleeve 916, and a post 918. Connector 910 is generally similar to connector 110, except detents 976 may be provided as an annular member that extends about all of sleeve 916 to engage lip 938 on body 912. Body 912 includes a front portion 926 and a rear portion 928, and further includes an inner surface 932, an outer surface 930, and an internal bore 934. Nut 914 includes a front portion 940 with an inner threaded surface 946, and a rear portion 942 having a flange 944. Sleeve 916 includes a front portion 962, an outer surface 966, an inner surface 968, and a rear portion 964, and defines a bore 984. Detent 978 and recess 980 on sleeve 916 engage lip 938 on body 912. Post 918 includes a flanged base portion 950, a radially enlarged portion 952, and a tubular portion 954 having one or more barbs 960 and defining a bore 958. One or more o-rings 922, 924 may further be utilized.

Referring further to FIGS. 9A and 9B, according to an exemplary embodiment, sleeve 916 includes a collapsible portion 973 (e.g. a thin-walled portion, a compressible portion, a deformable portion, etc.) having a first annular sidewall 970 and a second annular sidewall 972 coupled via an annular joint 974. According to an exemplary embodiment, first and second sidewalls 970, 972 are annular sidewalls configured to collapse, or deform, upon an axial force being applied to sleeve 916 and sleeve 916 being moved from the first position to the second position to form a barbed portion 986. Furthermore, sidewalls 970, 972 may be configured such that they form generally opposing portions that are perpendicular to inner surface 932 of body 912. First sidewall 970 may abut shoulder portion 936 to limit axial movement of sleeve 916. Joint 974 may provide a relatively smooth transition between first and second sidewalls 970, 972, or alternatively, may include a notch, relief, or similar feature to facilitate proper collapsing and/or deformation of first and second sidewalls 970, 972.

Referring generally to FIGS. 10A-13B, various collapsible portions are shown according to alternative embodiments. It should be understood that the various collapsible portions shown herein may be used in conjunction with any of the locking sleeves and/or coaxial cable connectors shown elsewhere herein. Furthermore, while FIGS. 10A-13B show various configurations for collapsible portions, it should be noted that the size, shape, and configurations of the collapsible portions may vary according to various exemplary embodiments. Furthermore, the collapsible portions may be integral components of a locking sleeve or similar connector component, or may be provided as discreet components.

Figure 10A:
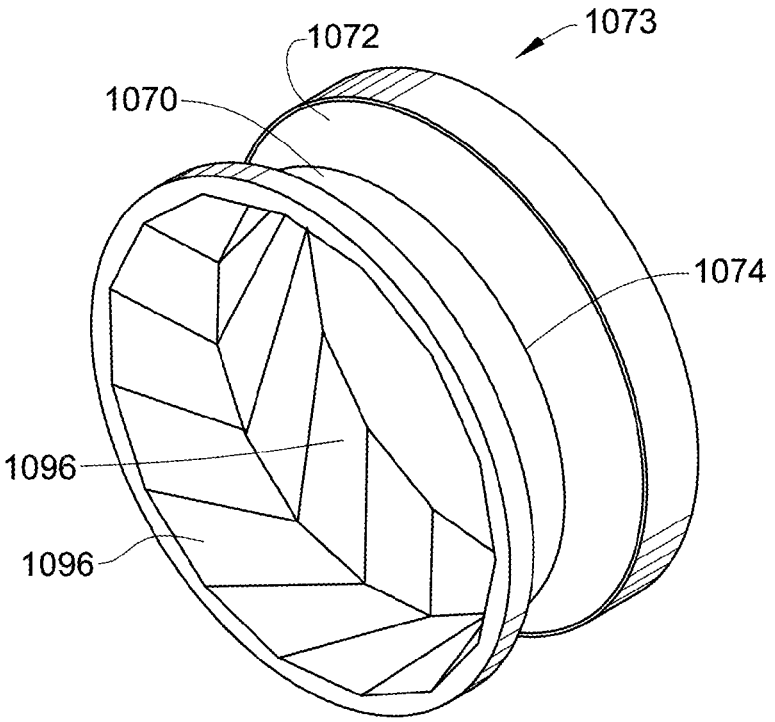
FIG. 10A is a perspective view of a collapsible portion for use with a coaxial cable connector according to an exemplary embodiment.
Figure 10B:
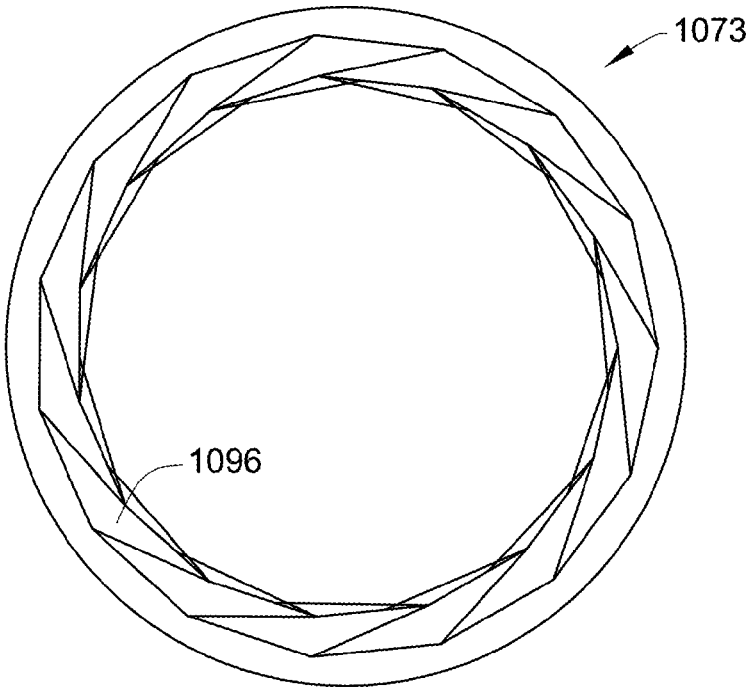
FIG. 10B is a side view of the collapsible portion of FIG. 10A according to an exemplary embodiment.

Referring to FIGS. 10A-10B, a collapsible portion 1073 is shown according to an exemplary embodiment. In one embodiment, collapsible portion 1073 includes a first annular sidewall 1070 and a second annular sidewall 1072 joined at a joint 1074. Each of first and second annular sidewalls 1070, 1072 may include a number of discrete inner surfaces 1096 (e.g., flats, etc.). In some embodiments each surface 1096 may be similar sized and shaped. In other embodiments, each surface 1096 may have a different size, shape, etc. Furthermore, the number, size, and/or shape of surfaces 1096 utilized may differ between first sidewall 1070 and second sidewall 1072. Providing surfaces 1096 may tend to provide a non-uniform and/or non-radial deformation of collapsible portion 1073 when utilized with various coaxial cable connectors. For example, individual surfaces 1096 may deform in different directions (e.g., nonradially, nonuniformly, etc.), may deform different distances, etc.

Figure 11A:
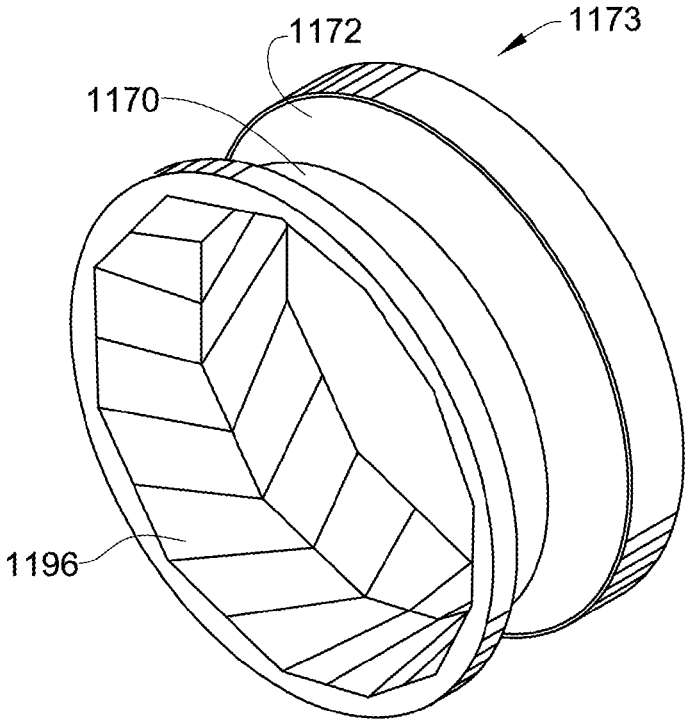
FIG. 11A is a perspective view of a collapsible portion for use with a coaxial cable connector according to an exemplary embodiment.
Figure 11B:
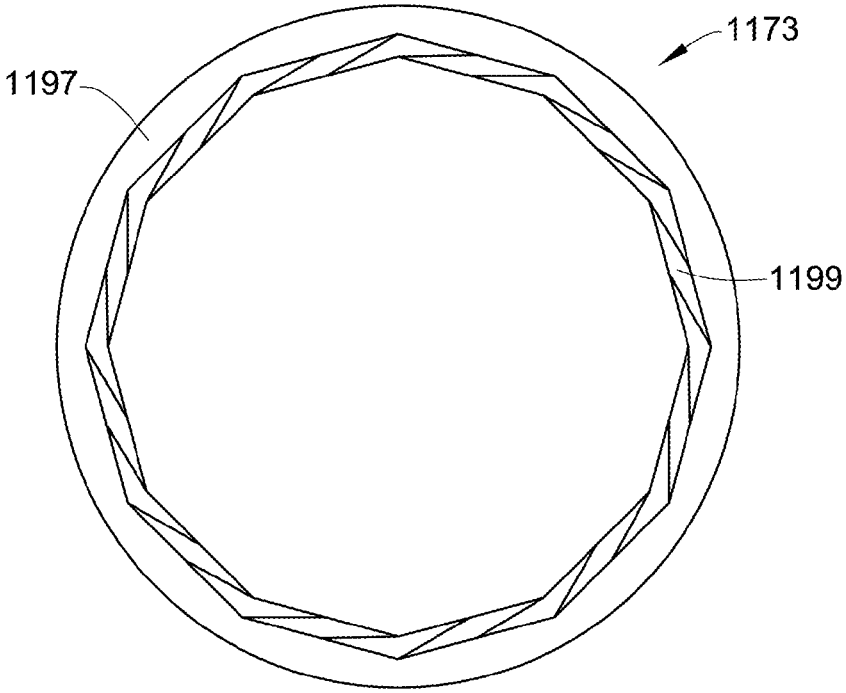
FIG. 11B is a side view of the collapsible portion of FIG. 11A according to an exemplary embodiment.
Figure 12A:
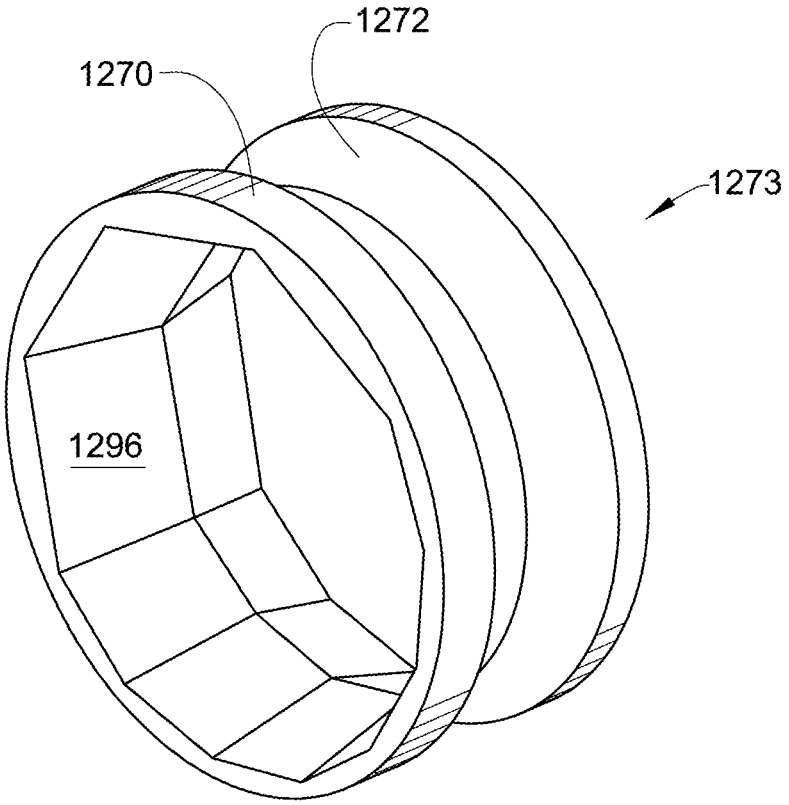
FIG. 12A is a perspective view of a collapsible portion for use with a coaxial cable connector according to an exemplary embodiment.
Figure 12B:
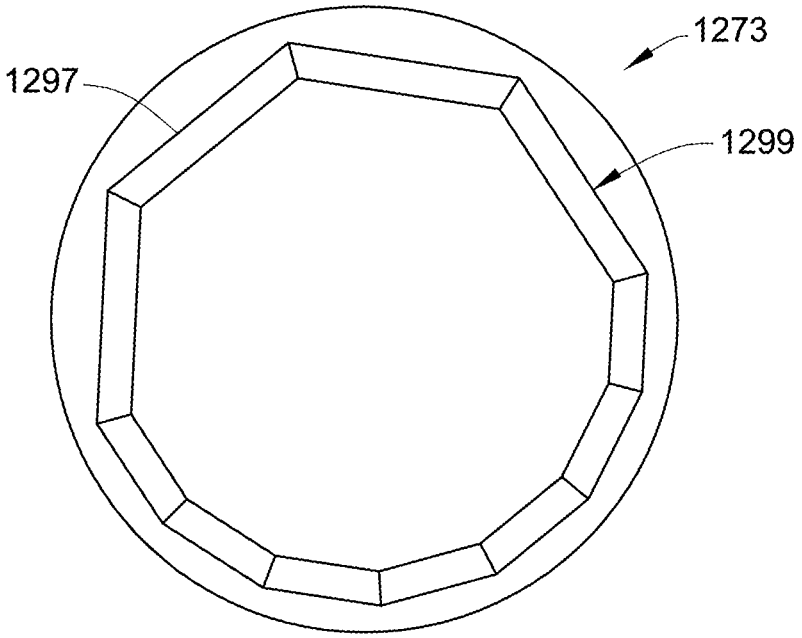
FIG. 12B is a side view of the collapsible portion of FIG. 12A according to an exemplary embodiment.

Referring to FIGS. 11A-11B, a collapsible portion 1173 is shown according to an exemplary embodiment. Collapsible portion 1173 includes sidewalls 1170, 1172 that define a number of discrete surfaces 1196 that are non-coplanar with each other. Furthermore, each of sidewalls 1170, 1172 is asymmetric in that, as shown in FIG. 11B, a number of flat portions 1197 extend about approximately one-half collapsible portion 1173, and a number of relatively shorter flat portions 1199 extend about the second half of collapsible portion 1173. For example, in one embodiment, collapsible portion 1173 includes five flat portions 1197 and seven flat portions 1199. As shown in FIGS. 11A-11B, two surfaces 1196 extend from each flat portion 1197, 1199. According to other embodiments, more or fewer flat portions may be provided. For example, as shown in FIGS. 12A and 12B, a collapsible portion 1273 having sidewalls 1270 and 1272 may include four flat portions 1297 and seven relatively shorter flat portions 1299, where a single discrete surface 1296 extends from each flat portion 1297, 1299.

Figure 13A:
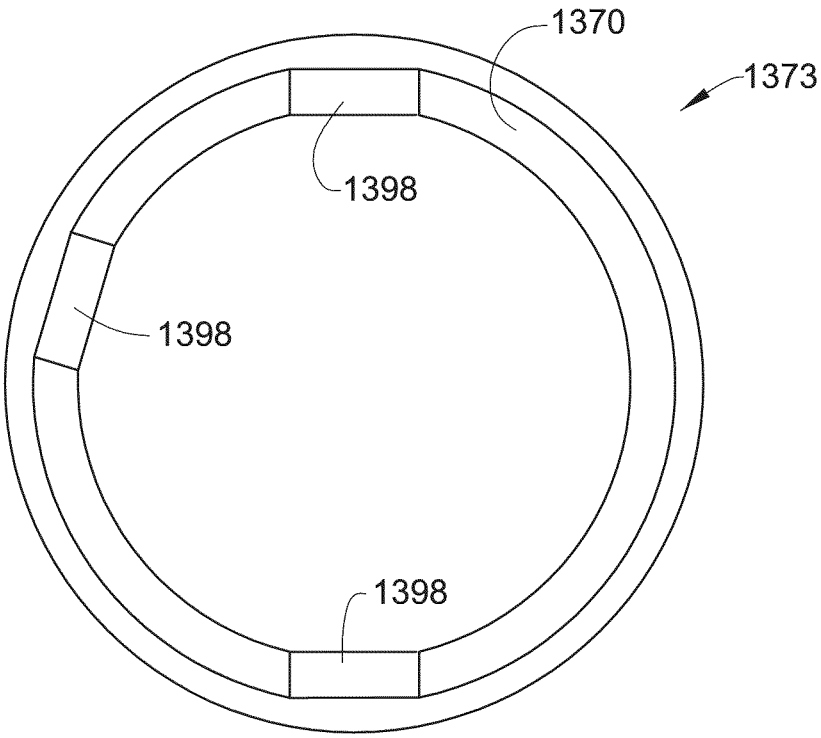
FIG. 13A is a side view of a collapsible portion for use with a coaxial cable connector according to an exemplary embodiment.
Figure 13B:
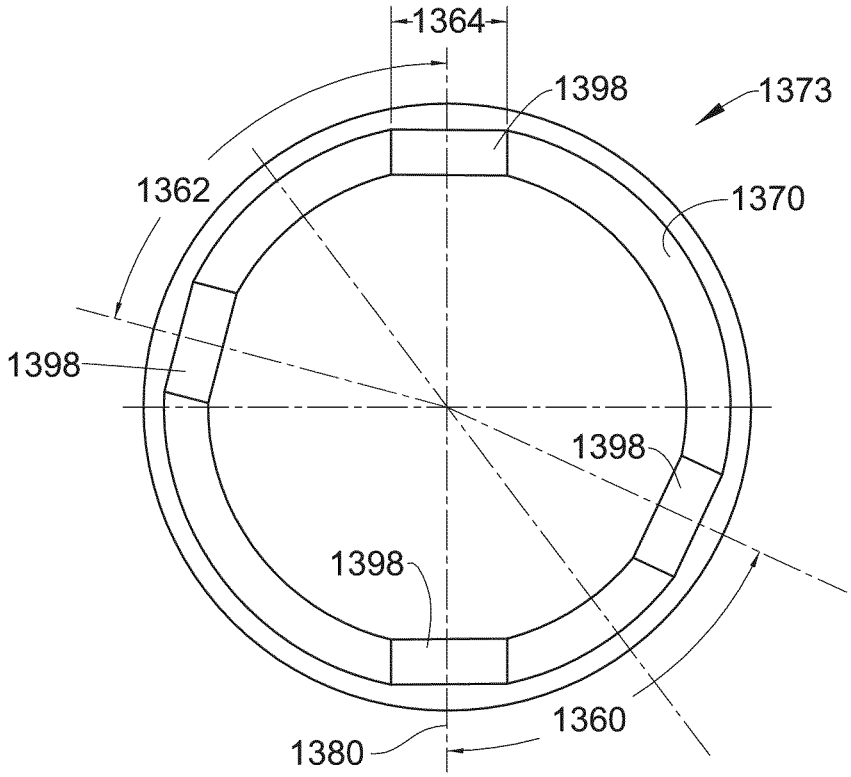
FIG. 13B is a side view of a collapsible portion for use with a coaxial cable connector according to another exemplary embodiment.

Referring to FIGS. 13A and 13B, a collapsible portion 1373 is shown according to an exemplary embodiment. Collapsible portion 1373 may be similar to collapsible portion 173, except that collapsible portion 1373 includes one or more interior "flats" 1398 provided at one or more locations about the interior of collapsible portion 1373 (e.g., on the sidewalls, etc.). According to one embodiment, four flats 1398 may be provided about sidewall 1370. As shown in FIG. 13B, two flats 1398 may be aligned in an opposing manner from each other and define a line 1380, and two additional flats 1398 may be provided at differing angles 1360, 1362 relative to line 1380 (e.g., 75 degrees and 65 degrees, etc.). The length 1364 may be any suitable length (e.g., 0.08 inches, more or less than 0.08 inches, etc.). The size and location of flats 1398, and the number of flats may be varied. For example, FIG. 13A shows collapsible portion 1373 having only three flats 1398 (e.g., two generally opposing flats and one offset flat). Any of a number of modifications may be made to suit a particular application.

It should be noted that the various features discussed herein with respect to the embodiments shown in the FIGURES may be used alone, or in combination, and all such features and combinations of features are within the scope of the present disclosure.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is important to note that the construction and arrangement of the elements of the coaxial cable connectors as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the embodiments. Accordingly, all such modifications are intended to be included within the scope of the present disclosure as defined in the appended claims. The order or sequence of any process or method steps may be varied or re-sequenced according to alternative embodiments. Other substitutions, modifications, changes, and/or omissions may be made in the design, operating conditions, and arrangement of the exemplary embodiments without departing from the spirit of the present disclosure.

What is claimed is:

1. A coaxial cable connector configured to connect a coaxial cable to a mating connector, the coaxial cable connector comprising:

a connector body having a forward end and a rearward end opposite the forward end, the rearward end configured to receive a coaxial cable;

an annular post disposed at least partially within the connector body; and a sleeve configured to be received within the connector body and movable from a first position to a second position relative to the connector body;

wherein the sleeve comprises a collapsible portion configured to collapse radially inward in an asymmetric fashion toward the post as the collapsible sleeve is moved from the first position to the second position.

2. The connector of claim 1, wherein the collapsible portion comprises a first annular sidewall and a second annular sidewall.

3. The connector of claim 2, wherein the first and second annular sidewalls form a forward-tilting grasping member in the second position, the grasping member configured to retain the coaxial cable within the connector.

4. The connector of claim 2, wherein the first and second sidewalls form an annular space between the collapsible portion and the connector body in the first position.

5. The connector of claim 4, further comprising a seal member provided within the annular space.

6. The connector of claim 2, wherein the first annular sidewall and the second annular sidewall are non-symmetric about a joint formed between the first annular sidewall and the second annular sidewall.

7. The connector of claim 2, wherein the body comprises a shoulder portion configured to limit forward axial movement of the sleeve within the body.

8. The connector of claim 2, wherein the first and second sidewalls of the sleeve extend relative to a longitudinal axis of the connector at differing angles.

9. The connector of claim 1, wherein the body comprises one of a detent and a recess configured to engage and retain the sleeve in the first position, and subsequently engage and retain the sleeve in the second position after movement of the sleeve from the first position to the second position.

10. The connector of claim 2, wherein the first and second sidewalls each comprises a plurality of discrete generally non-coplanar inner surfaces.

11. The connector of claim 10, wherein the plurality of discrete generally non-coplanar inner surfaces comprises at least two different sized surfaces.

12. The connector of claim 2, wherein at least a portion of the first annular sidewall is configured to move toward the second annular sidewall when the sleeve is moved from the first position to the second position.

13. The connector of claim 12, wherein the collapsible portion is configured to compress longitudinally as the sleeve is moved from the first position to the second position.

14. A coaxial cable connector configured to connect a coaxial cable to a mating connector, the coaxial cable connector comprising:

a connector body having a forward end and a rearward end opposite the forward end, the rearward end configured to receive a coaxial cable;

a nut coupled to the forward end of the body and configured to engage the mating connector;

an annular post disposed within the connector body; and a sleeve received within the connector body and movable from a first position to a second position, the sleeve comprising first and second annular sidewalls;

wherein the first and second annular sidewalls are configured to deform radially inward and form a forward-tilting grasping member as the sleeve is moved from the first position to the second position; and wherein the grasping member is configured to provide a compressive force on the coaxial cable.

15. The connector of claim 14, wherein the first and second annular sidewalls comprise inner and outer surfaces, the inner surfaces forming a first general V-shape and the outer surfaces forming a second general V-shape in the first position.

16. The connector of claim 14, wherein the second annular sidewall is relatively thicker than the first annular sidewall.

17. The connector of claim 14, wherein the connector body comprises a shoulder portion and a lip portion;

wherein the shoulder portion limits forward axial movement of the sleeve in both the first and second positions; and wherein the lip portion limits rearward axial movement of the sleeve in both the first and second positions.

18. The connector of claim 14, wherein at least a portion of the first annular sidewall is configured to move toward the second annular sidewall when the sleeve is moved from the first position to the second position.

19. The connector of claim 18, wherein the collapsible portion is configured to compress longitudinally as the sleeve is moved from the first position to the second position.

* * * * *